United States Patent [19]

Wolfson et al.

[11] Patent Number: 4,742,355

[45] Date of Patent: May 3, 1988

[54] SERPENTINE FEEDS AND METHOD OF MAKING SAME

[75] Inventors: Ronald I. Wolfson; William G. Sterns; John D. Foglesonger; Victor M. Petrillo, all of Los Angeles, Calif.

[73] Assignee: ITT Gilfillan, a Division of ITT Corporation, Van Nuys, Calif.

[21] Appl. No.: 906,060

[22] Filed: Sep. 10, 1986

[51] Int. Cl.[4] ..... H01Q 3/22; H01Q 13/00; H01P 1/20

[52] U.S. Cl. ..... 342/375; 343/770; 343/771; 343/767; 333/212; 333/230; 333/248; 29/600

[58] Field of Search ..... 342/375; 343/770, 771, 343/767; 338/212, 230, 248; 29/600

[56] References Cited

U.S. PATENT DOCUMENTS

| | | | |
|---|---|---|---|
| 2,824,305 | 2/1958 | Ohlemacher | 343/771 |
| 3,039,097 | 6/1962 | Strumwasser et al. | 343/771 |
| 3,438,035 | 4/1969 | Fling et al. | 343/771 |
| 4,119,971 | 10/1978 | Stark | 343/771 |
| 4,170,778 | 10/1979 | Bowman | 343/771 |
| 4,243,990 | 1/1981 | Nemit et al. | 343/770 |
| 4,297,705 | 10/1981 | Boothe | 342/375 |
| 4,500,882 | 2/1985 | Katagi et al. | 342/372 |
| 4,619,041 | 10/1986 | Davis et al. | 29/600 |

FOREIGN PATENT DOCUMENTS 1158134 12/1959 Fed. Rep. of Germany ..... 343/771

*Primary Examiner*—Theodore M. Blum
*Assistant Examiner*—David Cain
*Attorney, Agent, or Firm*—Robert A. Walsh; Thomas N. Twomey; Mary C. Werner

[57] ABSTRACT

An improved serpentine feed and method of making same. The invention includes a block of conductive material having a primary microwave waveguide channel and at least one secondary channel. Each secondary channel has at least one broadwall common to the primary channel. A high performance coupler is provided in the common broadwall by which microwave energy communicates from the primary channel to the secondary channel. The claimed method of the invention includes the steps of (a) machining mating halves of a first elongated channel into first and second blocks of conductive material; then, (b) machining mating halves of a plurality of second channels into the first and second blocks longitudinally parallel with at least a portion of the halves of the first channel thereby providing a plurality of common broadwalls between the first channel and each of the second channels; next, (c) machining a plurality of slots in each of the common broadwalls between selective first and second channels; and finally, (d) either mechanically fastening or bonding the first and second blocks in alignment such that halves of the first and second channels mate to provide primary and secondary microwave waveguides respectively.

4 Claims, 4 Drawing Sheets

FIG. 1
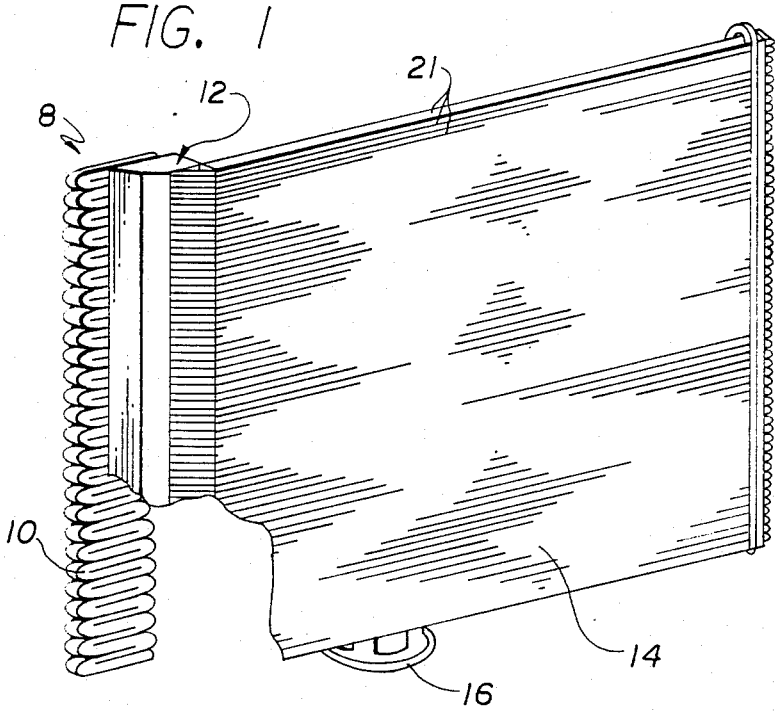
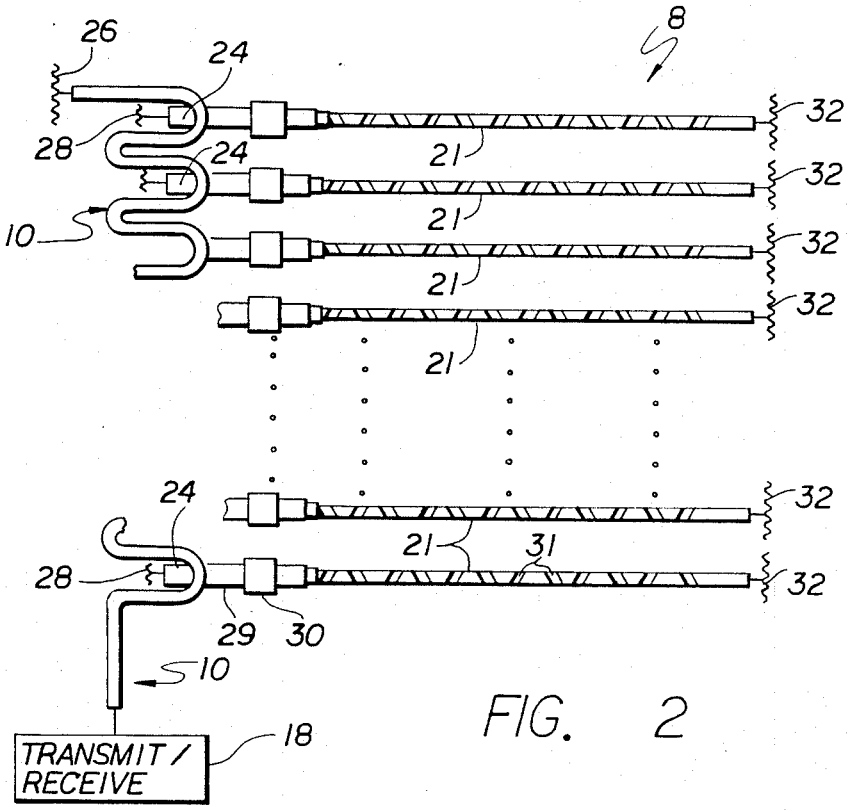
FIG. 2

FIG. 7
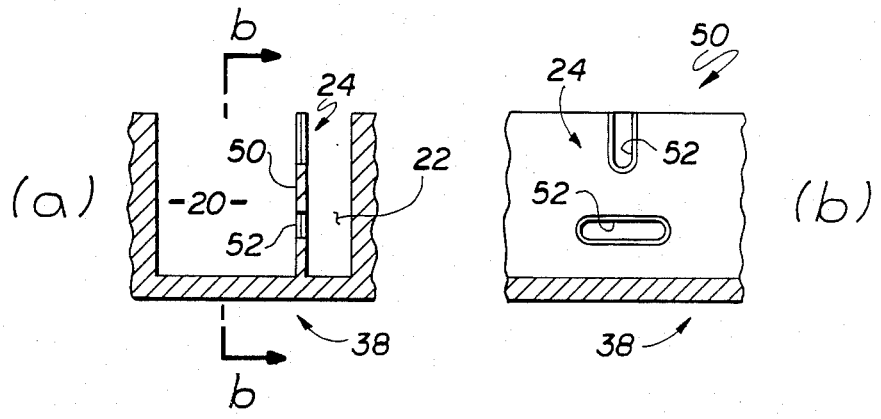
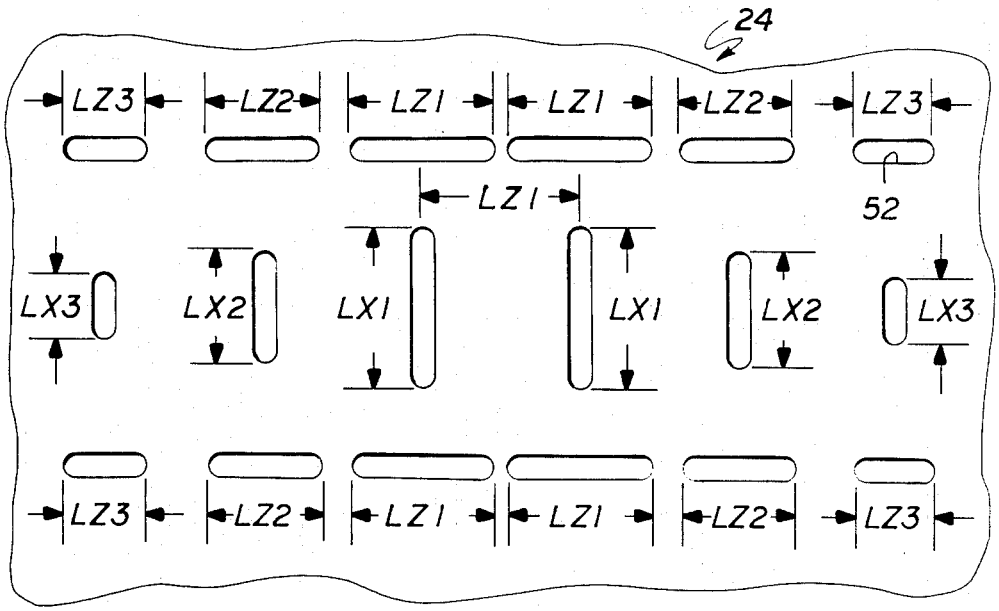
FIG. 8

SERPENTINE FEEDS AND METHOD OF MAKING SAME

BACKGROUND OF THE INVENTION

1. Field of the Invention

The present invention relates to high power microwave antenna feeds and to techniques for fabricating same.

While the invention is described herein with reference to a particular embodiment for a particular application, it is understood that the invention is not limited thereto. Those having ordinary skill in the art and access to the teachings of the present invention will recognized additional modifications and embodiments within the scope thereof.

2. Description of the Related Art

Sinuous or folded waveguide line feeds have been developed for high power microwave applications. Often referred to as "serpentine" feeds, these devices provide a low cost technique for feeding power to large planar arrays such as those used for land and ship based radar antennas.

As discussed in *Radar Handbook,* by Merrill I. Skolnik, published by McGraw Hill Company, 1970 and in the Final Report of Hughes entitled NOSC CR 219 (this report is subject to export controls), a serpentine feed is a long transmission line which is folded for space considerations giving it a serpentine shape. The line is tapped at periodic intervals to provide preselected amounts of power.

Within the serpentine is a primary (or main) channel through which the microwave energy passes. In addition, a number of secondary channels are coupled to sections or elements of the serpentine to provide output coupling. Typically, the coupling is provided by a plurality of slots in the main wall of the serpentine.

Initial attempts to fabricate serpentine feeds involved alignment of slots in the walls of the secondary waveguide with matching slots in the walls of the primary waveguide. This was problematic not only because of the difficulty associated with alignment, but also because, invariably, there were gaps between the walls. At high power levels, the gaps caused undesirable arcing and losses which degraded the performance of the system.

Therefore, the currently favored dip brazing technique was developed by which the otherwise slotted wall of the secondary channel is cut away and the shell of the secondary is brazed to the main waveguide. As disclosed in the Hughes Final Report, supra, dip brazing involves the application of a brazing material to the edges of the alloys to be brazed. The brazing material, typically aluminum or aluminum paste, acts as a bonding agent. The alloy and bonding agent are subjected to a number of heating stages as a prelude to a final heating in a bath, such as molten salt. The alloy is heated until it the agent melts and flows to form the brazed bond. At this point, the alloy is typically in a plastic state.

Despite its current popularity, there are numerous shortcomings associated with dip brazing:

(1) The secondary waveguide is typically brazed to the main waveguide at the narrow sidewall. This inhibits the use of broadwall-to-broadwall couplers which offer high performance. One such coupler is the Riblet-Saad coupler. (See "Directional Coupler Design Nomograms," by Tore N. Anderson, in *The Microwave Journal,* May 1959, pgs. 34,38.) This class of coupler has superior control of amplitude and phase over a wider bandwidth than do broadwall-to-sidewall or sidewall-to-sidewall couplers. The broadwall-to-broadwall coupler also permits a more compact serpentine design.

(2) The secondary waveguide structure is weakened by the removal of a side wall. Attempts to remove less of the wall have proved to be expensive with limited success. This increases the susceptibility to stress of the secondary waveguide.

(3) The dip brazing process is stressful for both structures because the brazing occurs near the melting point and there are often temperature variations within the bath. The stresses may cause deformations and distortions in the waveguides which introduce losses.

(4) The brazed seams are difficult to hold dimensionally and it is impractical to visually inspect the critical internal dimensions of brazed serpentines. As a result, the seams may be nonuniform causing additional insertion losses, higher voltage standing wave ratios (VSWR) and cumulative random phase errors.

(5) Dip brazed surfaces can take on a matte finish. These rougher surfaces produce significantly higher insertion losses in very high power systems.

(6) There are typically a multitude of pieces in brazed serpentines. As a result, there is typically a buildup of tolerances making it difficult to hold to design parameters.

(7) The serpentine is susceptible to mechanical damage after brazing and before hardening. Heat treating is problematic because of the possibility of distortion.

(8) Finally, since the brazed serpentine is not a unitary piece of metal, there often exists a pressure differential between the sections of the waveguide. This causes deformations in the waveguide which adversely affect performance. This problem has been addressed in the past by the use of metallic or foam stiffeners between the sections. However, the use of these stiffeners adds both to the weight and the cost of fabrication.

While a number of the disadvantages of dip brazing may be overcome by machining the serpentine from a single block of metal, there are other problems associated with the closure of the serpentine waveguides and the machining of the coupling slots. Thus, there exists in the art a need to address the shortcomings of prior serpentine fabrication techniques.

SUMMARY OF THE INVENTION

The shortcomings of prior techniques for fabricating serpentine feeds are addressed by the present invention which provides an improved serpentine feed and method of making same. The improved serpentine feed of the present invention is a block of conductive material having a primary microwave waveguide channel and at least one secondary channel. Each secondary channel has at least one broadwall common to the primary channel. A high performance coupler is provided in the common broadwall by which microwave energy communicates from the primary channel to the secondary channel.

The method of the invention includes the steps of (a) machining mating halves of a first elongated channel into first and second blocks of conductive material; then, (b) machining mating halves of a plurality of second channels into the first and second blocks longitudinally parallel with at least a portion of the halves of the first channel thereby providing a plurality of common broadwalls between the first channel and each of the second channels; next, (c) machining a plurality of slots in each of the common broadwalls between selective first and second channels and champfering the slots machined into the common broad walls; and finally, (d) either mechanically fastening or bonding the first and second blocks in alignment such that halves of the first and second channels mate to provide primary and secondary microwave waveguides respectively.

BRIEF DESCRIPTION OF THE DRAWINGS

FIG. 1 is a perspective view showing a serpentine feed in a typical operational environment.

FIG. 2 is a schematic diagram of a serpentine feed with a phased array antenna.

FIGS. 7(*a*) and 7(*b*) show side and front elevational sectional views respectively of a portion of a slot coupler in the common broadwall between the primary and secondary channel halves of the serpentine feed of the present invention.

FIG. 8 shows a typical high performance coupler slot pattern such as that used in the serpentine feed of the present invention.

DESCRIPTION OF THE INVENTION

Figure 3:
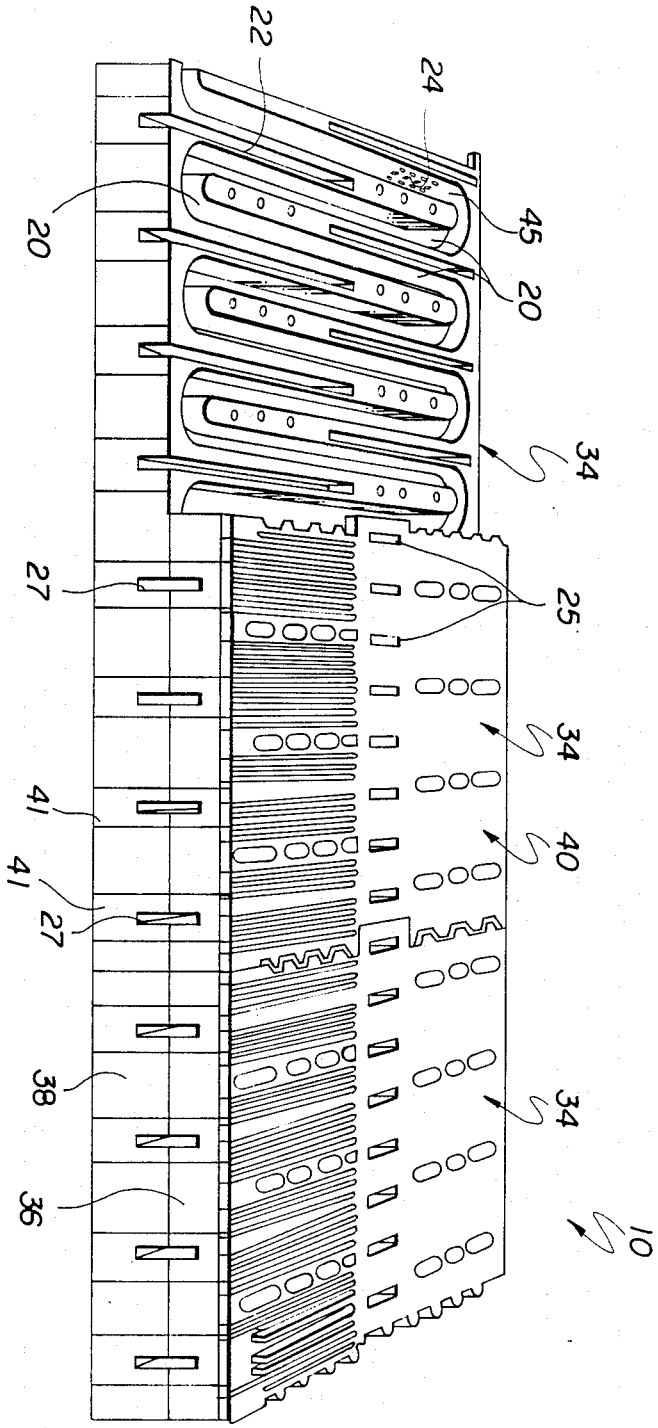
FIG. 3 is a perspective partially disassembled view of the serpentine feed of the present invention in a horizontal position.

The high power folded waveguide line feed of the present invention is illustrated in FIGS. 1–8. FIG. 1 shows the invention 10 in an operational environment. Accordingly, an array antenna 8 is shown with a serpentine feed 10, a plurality of phase shifters 12 and slotted waveguide arrays 14. The antenna 8 is attached to a mounting pedestal 16. Although the antenna 8 is shown partially fragmented to reveal the serpentine feed 10, it is understood that the invention is not limited to any particular mounting arrangement for the feed 10.

As shown in the schematic diagram of FIG. 2, the serpentine feed 10 is connected to a transmitter/-receiver 18. While the invention is described herein with the antenna 8 in a transmit configuration, it is understood that the invention is of comparable utility in receiving systems as is known in the art. In the transmit configuration, the transmitter/receiver 18 is a transmitter which provides input energy to the serpentine feed 10.

In the preferred embodiment, the serpentine feed 10 consists of 12 sections each of which has eight coupled ports, for a total of 96 elements. Three eight-element sections 34 are shown in the perspective view of FIG. 3. One section of the high power waveguide line feed 10 of the present invention is partially disassembled to reveal the folded primary channel 20.

The spacing of the serpentine feed 10 in the vertical direction is constrained or folded to allow for an optimal spacing of the horizontal elements 21 of the array 14. An optimal spacing minimizes grating lobes. (A grating lobe is a secondary peak in the output beam pattern. Secondary peaks in the output beam pattern reduce the power in the main beam and create ambiguities in the output signal.) The folds impart a serpentine feed shape hence the designation "serpentine".

As discussed more fully below, a plurality of secondary waveguide channels 22 are aligned broadwall-to-broadwall with the linear segments of the primary channel 20 between the miter bends. This permits the use of a broadwall-to-broadwall coupler 24 (which offers high performance relative to broadwall-to-sidewall and sidewall-to-sidewall couplers) without significantly adversely affecting the spacing of the horizontal elements 21.

In the schematic diagram of FIG. 2, the serpentine feed 10 is shown fragmented although it is understood that the serpentine would be of sufficient length to accommodate the dimensional and power requirements of the antenna 8.

Figure 4:
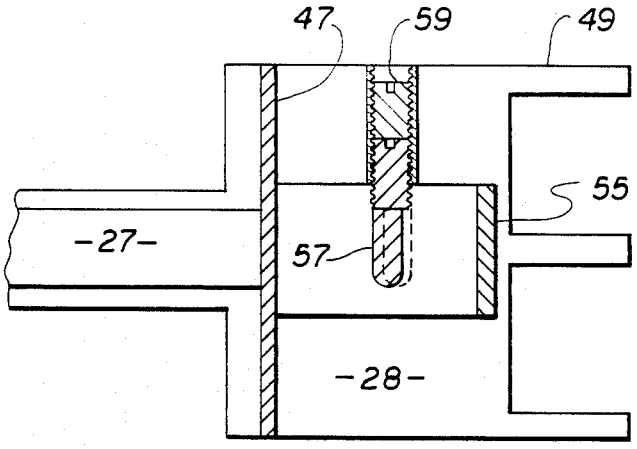
FIG. 4 is a sectional view of coupler load assembly utilized with the improved serpentine feed of the present invention.

The serpentine feed 10 is terminated by an off-the-shelf load 26. The load 26 is typically a rectangular waveguide dimensionally compatible with the waveguide and filled with a suitably absorbing material. For example, the absorbing material of the high power waveguide 10 of the preferred embodiment was stone. The couplers 24 are shown schematically in FIG. 2 as a plurality of directional four port couplers which provide for the transfer of microwave energy from the primary channel 20 of the serpentine feed 10 to the secondary channel 22. The input and output ports of the primary channel 20 provide two ports of the coupler 24 while the output port 25 of the secondary channel 22 provides a third port. The fourth port of the coupler 24 is the isolated port 27 of the secondary channel 22. (The output port 25 and the isolated port 27 are shown in FIG. 3.) The isolated port 27 is terminated by a matched load 28 while the output port 25 is connected to a microwave transformer 29. The load 28 may be either of an internal design for moderate power levels or of an external design (eg. finned) for high power levels. A cross sectional view of a load assembly 28 such as that used with the preferred embodiment is shown in FIG. 4. The load 28 includes a resonant iris 47 which acts as an interface between the port 27 and the load housing 49. Within the housing 49 is a polyiron load block 55 which in the preferred embodiment is a slab of Emerson & Cumming MF 500F-117 load material. An eccentric tuning screw 57 is included and secured with a jam screw 59. This load configuration met the frequency, bandwidth, return loss, power handling capability (peak and average), size and length requirements of the preferred embodiment. Those of ordinary skill in the art will recognize that other load configurations may be used to address other design requirements.

The transformer 29 is a microwave conductor which matches the size of the output port 25 to that of a ferrite phase shifter 30 or array 14 if no phase shifter is used. The phase shifter feeds a horizontal element 21 of the array 14.

As is known in the art, the phase shifter 30 is designed to provide the requisite degree of phase shift in view of the pattern requirements and side lobe levels of the antenna. The designer can have a suitable phase shifter fabricated to such specifications as operating frequency, phase accuracy, size of phase bits, insertion loss, power handling capability and etc. by such companies as Magnetic Applications Group of Santa Maria California and Electromagnetic Sciences Inc. of Atlanta Georgia.

Each horizontal element 21 of the array 14 provides a series waveguide which distributes the power in the horizontal plane as the serpentine feed 10 distributes the power in the elevational plane. Each element 21 includes a plurality of slots 31 to provide a power taper for the output beam. When energy flows in the element 21, the slots cause a current imbalance and corresponding energy radiation depending on the degree of slant of each slot. Each element 21 is terminated by an off-the-shelf load 32.

Figure 5:
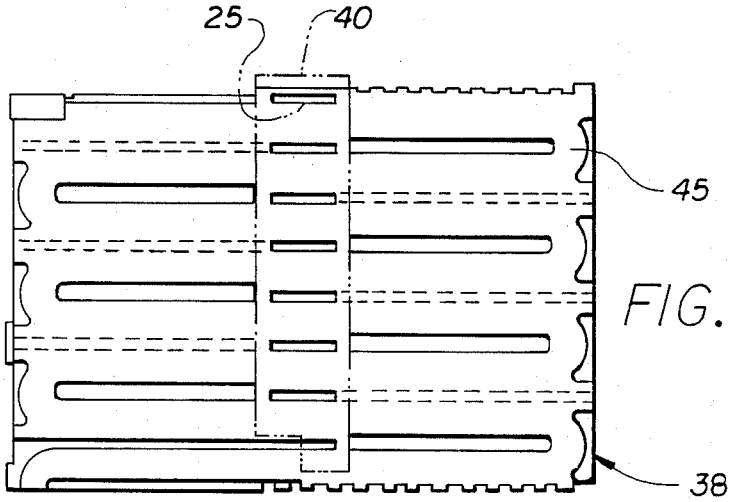
FIG. 5 is a top plan view of the serpentine feed of the present invention.

Referring again to FIG. 3 where three eight-element sections 34 of the serpentine feed 10 are shown, each section is identical except for the coupling slots discussed below. Each section 34 is fabricated from mating upper and lower blocks of aluminum or other suitable material, 36 and 38 respectively, which part on the centerline of the waveguide broadwalls. As mentioned above, one upper block 36 is removed to reveal the design of the primary channel 20 and secondary channel 22. FIG. 5 shows a top plan view of a lower block 38. The primary channel 20 includes a plurality of 180 degree miter E-bends 45 which may be either large radius type or of a multiple-miter type as is known in the art. The miter bend can be matched to an arbitrarily small voltage standing wave ratio (VSWR) over an appreciable operating band simply by assigning the proper length to each miter section, whereas a discrete matching element is required with the radius bend. As is known in the art, the design of the 180 degree miter bend 45 must be verified experimentally, as the complexity of the problem precludes an analytical solution. Nonetheless, the methodology is as follows:

a. Scale the design from a 90 degree E-bend;

b. Fabricate a split-block 180 degree bend test fixture;

c. Measure the VSWR;

d. Add a tuning screw near the center of each miter face;

e. Retune for optimum VSWR;

f. Remachine miters according to the degree of screw tuning required;

g. Remeasure VSWR;

h. Reiterate steps (e) through (g) until desired match over the operating band is achieved;

i. Verify design eg. fabricate test fixture.

A common flange 40 with coupled output ports 25 is illustrated in FIG. 3 and shown in phantom in FIG. 5. The coupled output ports 25 are located in a line on the common flange 40. The flange 40 and a 90 degree H-bend (not shown) for each secondary channel 22 are machined in the upper blocks 36. As shown in FIG. 3, the isolated ports 27 exit to a flange 41 machined on the sides of the blocks 36 and 38.

Figure 6:
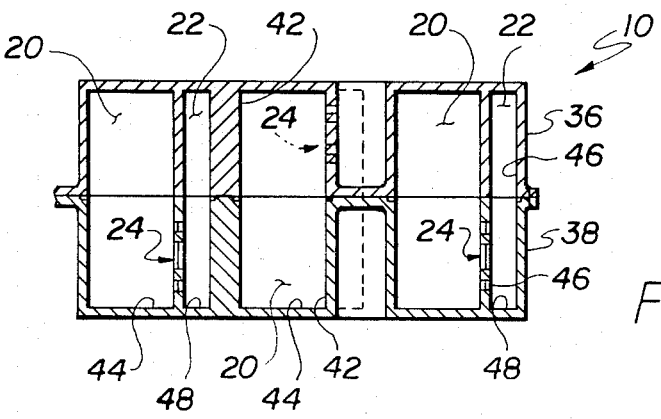
FIG. 6 is a sectional side view of the primary and secondary channels of the fully assembled serpentine feed of the present invention.

FIG. 6 shows a cross-sectional view of a portion of the serpentine feed 10 with upper and lower blocks 36 and 38 in place. The blocks 36 and 38 cooperate to provide a continuous primary channel 20 with broadwalls 42 and sidewalls 44. Similarly, the smaller secondary channels 22 are located close to the primary channel 20 to minimize RF losses through the common broadwall 50 and have broadwalls 46 and sidewalls 48 respectively. The four ports couplers 24 are mounted in the broadwalls 50 that are common to the primary and secondary channels 20 and 22 respectively. Front and side views of a portion of one coupler 24 is shown in the exploded views of FIGS. 7(*a*) and 7(*b*) respectively. Each coupler 24 is made of a plurality of slots 52. The coupling slots 52 are mounted alternately in the common broadwall 50 of the upper block 36 and the lower block 38. This produces a corresponding left and right placement of the secondary channels 22 relative to the primary channel 20.

The broadwall-to-broadwall couplers 24 are high-directivity, four port devices that substantially isolate the primary channel 20 from mismatches in the secondary channels 22. The size, shape and location of the slots 52 varies from one coupler design to another. Ideally, the fabrication method of the chosen coupler would be compatible with the all machined construction of the serpentine. A Riblet-Saad broadwall-to-broadwall type coupler was incorporated into the design of the serpentine feed 10 of the preferred embodiment. A six-group slot pattern of a Riblet-Saad coupler is shown in FIG. 8. The pattern is carefully synthesized, in a manner known in the art, to provide a predetermined amount of coupling, isolation, and low internal reflection. Broadwall-to-broadwall couplers are easily implemented. This class of coupler offers superior control of amplitude and phase over a wider bandwidth than do broadwall-to-sidewall couplers. Such coupler configurations also permit a more compact serpentine design. In addition, the block of metal stock required is smaller and less material needs to be removed by the machining process. It is therefore a significant feature of the design of the present invention that permits the use of broadwall-to-broadwall couplers.

The method of fabricating the improved serpentine feed of the present invention 10 is as follows:

(1) For each element 34 of the serpentine feed 10 two mating blocks 36 and 38 of aluminum or other suitable material are selected. Ideally, each block is as stress relieved as possible. If not, the blocks are stress relieved prior to machining.

(2) Next, using a numerically controlled machine or other suitable tool, mirror half images of the primary channel 20 are rough cut into each block.

(3) Similarly, with a smaller tool, mirror half images of the secondary channels 22 are rough cut into each block.

(4) Then the top of each block is faced off or finished with a flywheel cutter.

(5) Next, the primary and secondary channels 20 and 22 respectively are given a secondary cut to within a few thousandths of the final dimensions.

(6) Then, a final cut to within a few ten thousandths of the desired dimensions is made to both channels.

(7) The coupling slots are cut in the common broadwalls 50 with, for example, a right angle mill, as per the design of the selected coupling arrangement and finally, (8) The edges on the slots are removed by a suitable tool or by a chemical etch.

During the machining process, it may be necessary to stress relieve the blocks before the next cut is made. Tongues and grooves are also cut in the blocks to facilitate the alignment and fastening of the blocks together. That is, a bonding epoxy is applied to the blocks, the tongues and groove are aligned, the upper block 36 is mounted on the lower block 38 and secured in place with nuts and bolts. Machined web or rib stiffeners are added for reinforcement were needed.

In operation, input microwave energy is applied to the serpentine feed 10 by the transmitter 18. At each of the coupling ports 24, a portion of the energy in the primary channel 20 is coupled off to the secondary channel 22. Energy from the secondary channel is phase shifted and applied to a horizontal element 21 of the array 14. Energy flowing in the horizontal element 21 is radiated from the slots 31 depending on the degree of slant of each. Thus, vertical power distribution of the array is determined by the coupling taps along the serpentine feed 20. The horizontal power distribution is determined by the number, location and slant of the slots 31. Beam sweeping in the vertical plane is accomplished by changing the input frequency. Beam steering in the horizontal plane, if desired, is provided by mechanically rotating the antenna 8.

The present invention has been described herein with reference to an illustrative embodiment in connection with a particular application. Those of ordinary skill in the art and access to the teachings of the present invention will recognize additional modifications, applications and embodiments within the scope of thereof. For example, the invention is not limited to a particular coupling design. The method of the present invention is not limited to any particular number of machining steps. Nor is it limited to the order of the machining and stress relieving steps. Further, the invention may find utility in other microwave applications.

It is intended by the appended claims to cover any and all such modifications, applications and embodiments within the scope of the invention.

Therefore,

What is claimed is:

1. A method of fabricating high power folded waveguide line feeds including the steps of:

(a) machining mating halves of a first elongate channel into first and second blocks of conductive material;

(b) machining mating halves of a plurality of second channels into said first and second blocks longitudinally parallel with at least a portion of said halves of said first channel thereby providing a plurality of common broadwalls between the respective halves of said first channel and each of said second channels;

(c) machining a plurality of slots in each of said common broadwalls between selective halves of said first and second channels; and (d) fastening said first and second blocks in alignment such that said halves of said first and second channels mate to provide primary and secondary microwave waveguides respectively.

2. The method of fabricating high power folded waveguide line feeds of claim 1 including the step of champfering the slots machined into said common broadwalls.

3. The method of fabricating high power folded waveguide line feeds of claim 1 including the step of stress relieving the first and second blocks prior to said bonding step.

4. The method of fabricating high power planar array folded waveguide line feeds of claim 1 wherein the steps of machining said first channel and said plurality of second channels includes the steps of:

(a) machining a first rough cut for said first and second channels;

(b) machining a second finer cut of said first and second channels to set said channels dimensionally; and (c) machining a third cut to provide a surface finish.

* * * * *